US010754290B2

(12) United States Patent
Adachi et al.

(10) Patent No.: US 10,754,290 B2
(45) Date of Patent: Aug. 25, 2020

(54) IMAGE FORMING APPARATUS

(71) Applicant: BROTHER KOGYO KABUSHIKI KAISHA, Nagoya-shi, Aichi-ken (JP)

(72) Inventors: Aya Adachi, Nagoya (JP); Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/421,432

(22) Filed: May 23, 2019

(65) Prior Publication Data

US 2019/0361390 A1 Nov. 28, 2019

(30) Foreign Application Priority Data

May 24, 2018 (JP) ..... 2018-099439

(51) Int. Cl.
*G03G 21/16* (2006.01)
*G03G 15/00* (2006.01)
*G03G 21/18* (2006.01)

(52) U.S. Cl.
CPC ..... *G03G 21/1633* (2013.01); *G03G 15/6511* (2013.01); *G03G 21/1647* (2013.01); *G03G 21/185* (2013.01)

(58) Field of Classification Search
CPC ..... G03G 21/1633; G03G 2221/169; B65H 2407/21
See application file for complete search history.

(56) References Cited

U.S. PATENT DOCUMENTS 5,418,606 A * 5/1995 Kikuchi ..... G03G 15/326 399/381
2005/0253323 A1 11/2005 Fujita et al.
2014/0252715 A1 9/2014 Minoshima et al.
2014/0292971 A1 10/2014 Uchino et al.

FOREIGN PATENT DOCUMENTS

JP 2006-337477 A 12/2006
JP 4200117 B2 12/2008
JP 5626031 B2 11/2014
JP 5828330 B2 12/2015
JP 6051962 B2 12/2016

* cited by examiner

*Primary Examiner* — Erika J Villaluna
(74) *Attorney, Agent, or Firm* — Kenealy Vaidya LLP

(57) ABSTRACT

An image forming apparatus includes: a main body casing including a first opening and a cover that is movable between an open position and a closed position; and a cartridge, which is capable of accommodating a toner and is mountable to the main body casing in a state where the cover is positioned in the open position; wherein the main body casing includes: a first tray, which is provided on the cover and is capable of placing a print medium thereon; a second opening, through which the print medium on the first tray passes; a first conveyance roller, which conveys the print medium passed through the second opening; a third opening, which is positioned between the first opening and the second opening; and a guide, which guides the print medium passed through the third opening to the first conveyance roller.

16 Claims, 7 Drawing Sheets

IMAGE FORMING APPARATUS

CROSS-REFERENCE TO RELATED APPLICATION

This application claims priority from Japanese Patent Application No. 2018-099439 filed on May 24, 2018, the entire subject matter of which is incorporated herein by reference.

TECHNICAL FIELD

This disclosure relates to an image forming apparatus.

BACKGROUND ART

An background image forming apparatus includes a first opening for mounting a cartridge, a cover capable of opening and closing the first opening, a tray provided on the cover, and a second opening through which a print medium on the tray passes.

SUMMARY

There is cases where a user desires to print on a print medium different from a print medium placed on the tray while the print medium is being placed on the tray.

The present disclosure is to provide an image forming apparatus with a configuration including a cover capable of opening and closing a first opening for mounting a cartridge in the image forming apparatus, in a state where the print medium is placed on the first tray provided on the cover, the image forming apparatus can print on a print medium different from the print medium placed on the first tray.

An image forming apparatus of this disclosure includes: a main body casing including a cover that is movable between an open position, at which a first opening of the main body casing is opened, and a closed position, at which the first opening is closed; and a cartridge, which is capable of accommodating a toner and is mountable to the main body casing via the first opening, in a state where the cover is positioned in the open position.

The main body casing includes: a first tray, which is provided on the cover and is capable of placing a print medium thereon; a first conveyance roller, which conveys the print medium placed on the first tray passed through a second opening positioned below the first opening; and a guide, which guides the print medium passed through a third opening to the first conveyance roller, the third opening being positioned between the first opening and the second opening.

According to such a configuration, in the configuration including the first opening for mounting the cartridge in the image forming apparatus and the cover capable of opening and closing the first opening, the main body casing includes a first tray provided on the cover and a third opening different from the second opening through which the print medium placed on the first tray passes and through which the print medium can pass.

Therefore, in a state where the print medium is placed on the first tray, the third opening can be used to print on the print medium different from the print medium placed on the first tray.

Moreover, according to such a configuration, the print medium passed through the third opening can be conveyed by using the conveyance roller for conveying the print medium passed through the second opening.

Therefore, the configuration of the image forming apparatus can be prevented from becoming complicated, and printing can be performed on the print medium different from the print medium placed on the first tray.

According to the image forming apparatus of this disclosure, in the configuration including the first opening for mounting the cartridge in the image forming apparatus and the cover capable of opening and closing the first opening, in a state where the print medium is placed on the first tray provided on the cover, printing can be performed on the print medium different from the print medium placed on the first tray.

BRIEF DESCRIPTION OF DRAWINGS

The foregoing and additional features and characteristics of this disclosure will become more apparent from the following detailed descriptions considered with the reference to the accompanying drawings, wherein.

DETAILED DESCRIPTION

1. The outline of an image forming apparatus 1 will be described with reference to FIG. 1 and FIG. 2 of the image forming apparatus 1.

Figure 1:
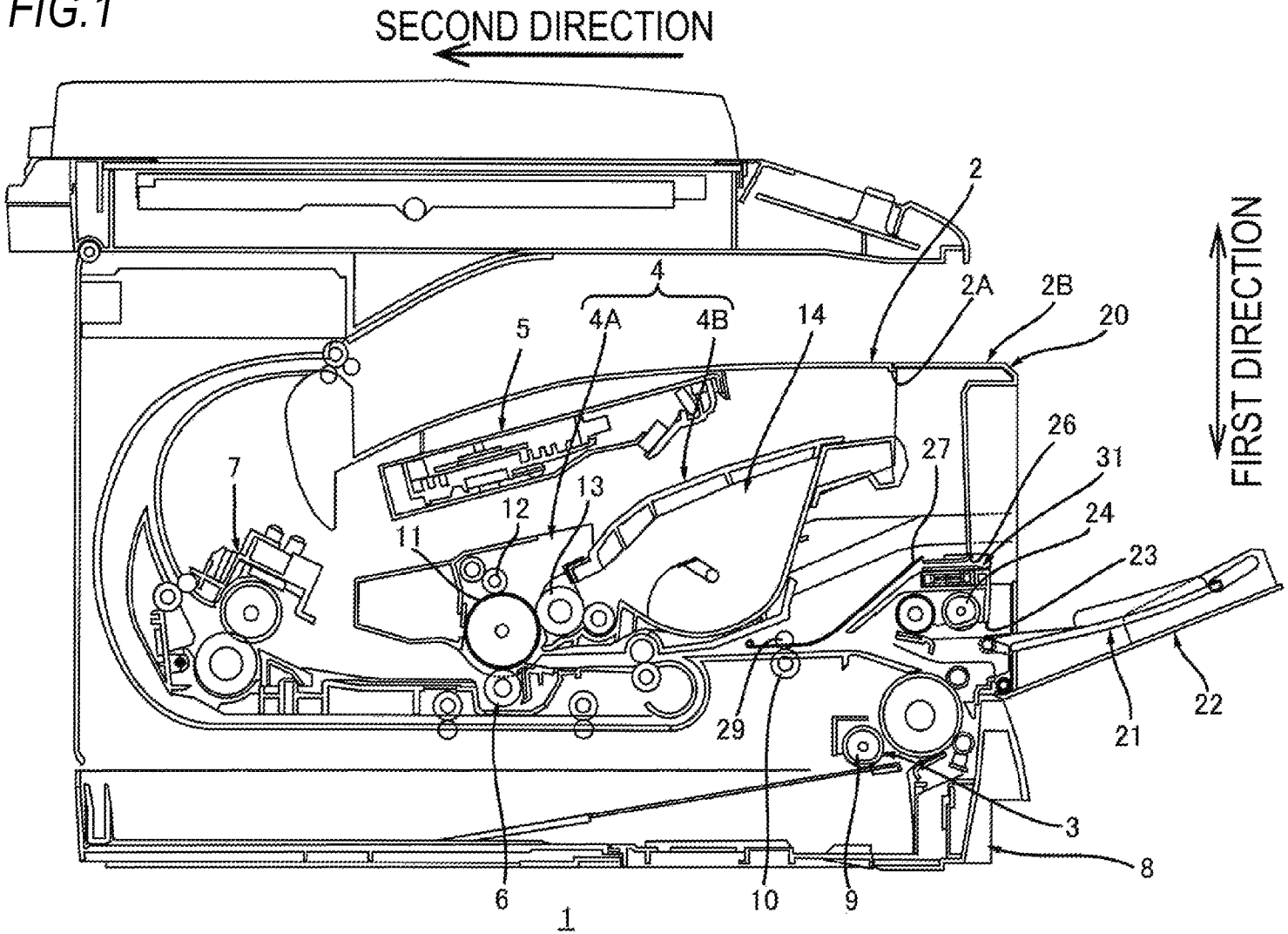
FIG. 1 is a central sectional view of an image forming apparatus.

As shown in FIG. 1, the image forming apparatus 1 includes a main body casing 2, a sheet feeding portion 3, a cartridge 4, an exposure device 5, a transfer roller 6, and a fixing device 7.

1.1 Main Body Casing

The main body casing 2 configures an exterior of the image forming apparatus 1. The main body casing 2 accommodates the sheet feeding portion 3, the cartridge 4, the exposure device 5, the transfer roller 6, and the fixing device 7. The main body casing 2 includes a first opening 2A (see FIG. 2) and a cover 2B.

The first opening 2A is positioned on the opposite side of the fixing device 7 with respect to the cartridge 4 in a state where the cartridge 4 is mounted to the image forming apparatus 1.

The cover 2B is movable between an open position (see FIG. 2) at which the first opening 2A is opened and a closed position (see FIG. 1) at which the first opening 2A is closed. Specifically, the cover 2B is pivotable about a first axis A1 between the open position and the closed position. The cover 2B will be described in detail later.

1.2 Sheet Feeding Portion

The sheet feeding portion 3 includes a cassette 8, a first pickup roller 9, and a conveyance roller 10. That is, the image forming apparatus 1 includes the cassette 8, the first pickup roller 9, and the conveyance roller 10.

The cassette 8 can accommodate a print medium P1. The print medium P1 is, for example, a print sheet. The cassette 8 can be mounted to the main body casing 2. The cassette 8 is positioned below the cartridge 4 in a state of being mounted to the main body casing 2.

The first pickup roller 9 picks up the print medium P1 accommodated in the cassette 8. The print medium P1 picked up by the first pickup roller 9 is conveyed to a photosensitive drum 11.

1.3 Cartridge

Figure 2:
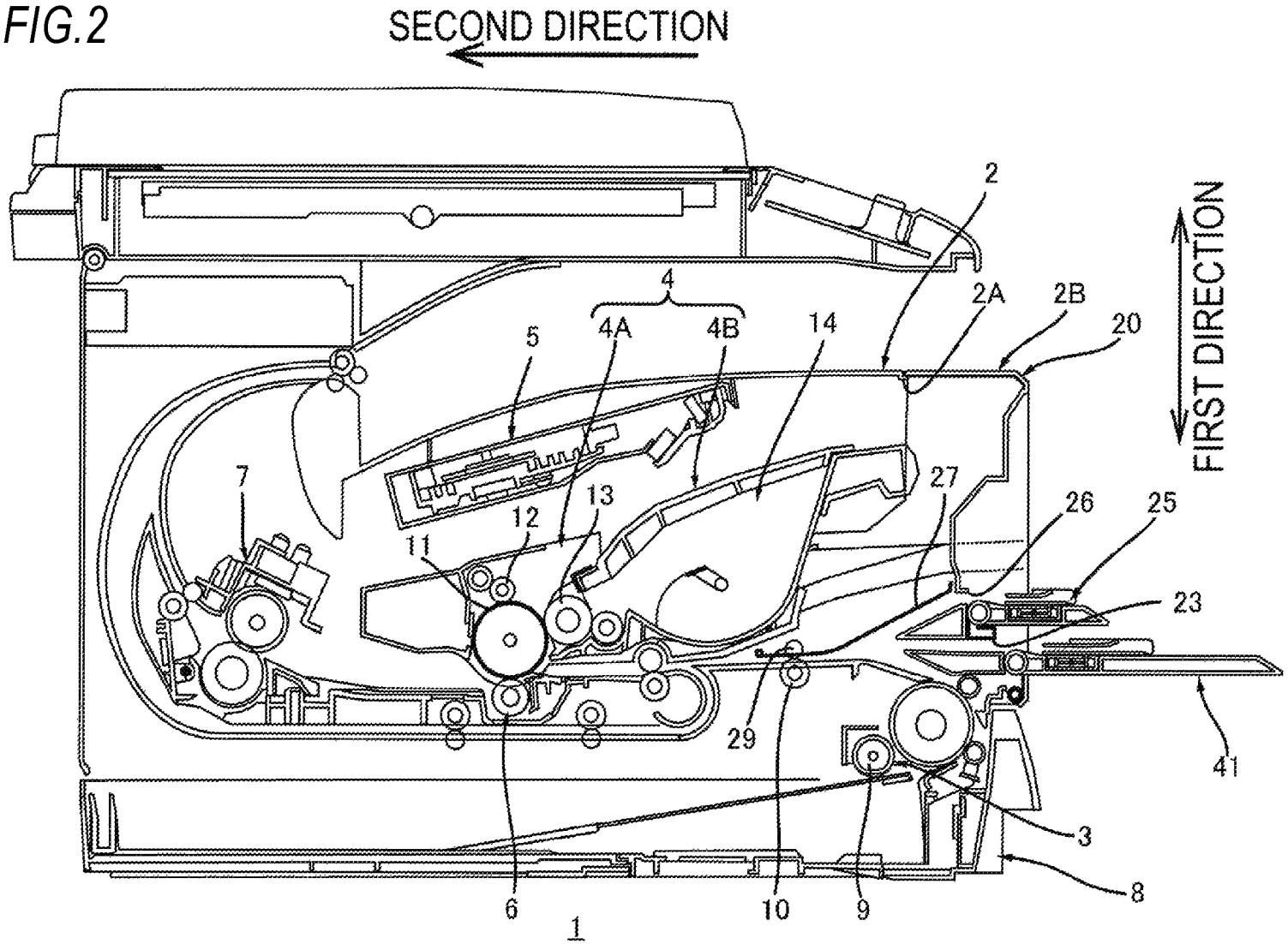
FIG. 2 shows the image forming apparatus shown in FIG. 1 with a state where the cover is positioned in the open position and the cartridge is removed from the image forming apparatus.

As shown in FIG. 2, the cartridge 4 can be mounted to the main body casing 2 via the first opening 2A when the cover 2B is positioned in the open position. As shown in FIG. 1, the cartridge 4 includes the photosensitive drum 11, a charging roller 12, a developing roller 13, and a toner container 14. Specifically, the cartridge 4 includes a drum cartridge 4A including the photosensitive drum 11 and the charging roller 12, and a developing cartridge 4B including the developing roller 13 and the toner container 14. The developing cartridge 4B can be attached to the drum cartridge 4A.

The photosensitive drum 11 can rotate about an axially extending shaft. The photosensitive drum 11 extends in the axial direction and has a cylindrical shape.

The charging roller 12 charges the peripheral surface of the photosensitive drum 11. The charging roller 12 contacts the peripheral surface of the photosensitive drum 11. The cartridge 4 may include a non-contact charger such as a scorotron charger instead of the charging roller 12.

The developing roller 13 supplies a toner in the toner container 14 to the photosensitive drum 11. The developing roller 13 contacts the peripheral surface of the photosensitive drum 11.

The toner container 14 can accommodate the toner. That is, the cartridge 4 can accommodate the toner.

1.4 Exposure Device

The exposure device 5 is configured to expose the photosensitive drum 11. Specifically, the exposure device 5 exposes the peripheral surface of the photosensitive drum 11 charged by the charging roller 12. Accordingly, an electrostatic latent image is formed on the peripheral surface of the photosensitive drum 11. A toner image is formed on the peripheral surface of the photosensitive drum 11 by supplying the toner to the electrostatic latent image by the developing roller 13. The exposure device 5 is positioned above the cartridge 4 in a state where the cartridge 4 is mounted in the image forming apparatus 1. Specifically, the exposure device 5 is a laser scan unit.

1.5 Transfer Roller

The transfer roller 6 contacts the photosensitive drum 11 in a state where the cartridge 4 is mounted to the image forming apparatus 1. The print medium P1 from the cassette 8 passes between the transfer roller 6 and the photosensitive drum 11. At this time, the transfer roller 6 transfers the toner image formed on the peripheral surface of the photosensitive drum 11 to the printing medium P1.

1.6 Fixing Device

The fixing device 7 is configured to heat and pressurize the print medium P1 to which the toner image is transferred, thereby fixing the toner image on the print medium P1. The print medium P1 passed through the fixing device 7 is discharged to the upper surface of the main body casing 2.

2. Details of Cover 2B

Next, details of the cover 2B will be described with reference to FIG. 1 to FIG. 4.

The cover 2B includes a cover body 20, a first tray 21, a tray cover 22, a second tray 25, and a third opening 26. That is, the main body casing 2 includes the first tray 21 and the third opening 26.

2.1 Cover Body

As shown in FIG. 1 and FIG. 2, the cover body 20 supports the first tray 21, the tray cover 22, and the second tray 25. When the cover 2B is positioned in the closed position, the cover body 20 closes the first opening 2A. When the cover 2B is positioned in the open position, the cover body 20 opens the first opening 2A. When the cover 2B is positioned in the closed position, the cover body 20 extends in a first direction. The first direction intersects the axial direction. Preferably, the first direction is orthogonal to the axial direction. Specifically, the first direction is a vertical direction. In a state where the cover 2B is positioned in the closed position, the cover body 20 includes one end E1 in the first direction and the other end E2 in the first direction. In a state where the cover 2B is positioned in the closed position, the other end E2 is positioned apart from the one end E1 in the first direction. In a state where the cover 2B is positioned in the closed position, the other end E2 is positioned between the one end E1 and the cassette 8 in the first direction. The first axis A1 is positioned in the other end E2 of the cover body 20. The cover body 20 is pivotable about the first axis A1.

The cover body 20 includes an inner surface S1 and an outer surface S2. The inner surface S1 faces the inside of the image forming apparatus 1 in a state where the cover 2B is positioned in the closed position. The inner surface S1 is positioned between the cartridge 4 and the outer surface S2 in a state where the cartridge 4 is mounted to the image forming apparatus 1 and the cover 2B is positioned in the closed position. The outer surface S2 faces the outside of the image forming apparatus 1 in a state where the cover 2B is positioned in the closed position. The outer surface S2 is positioned on the opposite side of the cartridge 4 with respect to the inner surface S1 in a state where the cartridge 4 is mounted to the image forming apparatus 1 and the cover 2B is positioned in the closed position.

2.2 First Tray

Figure 3:
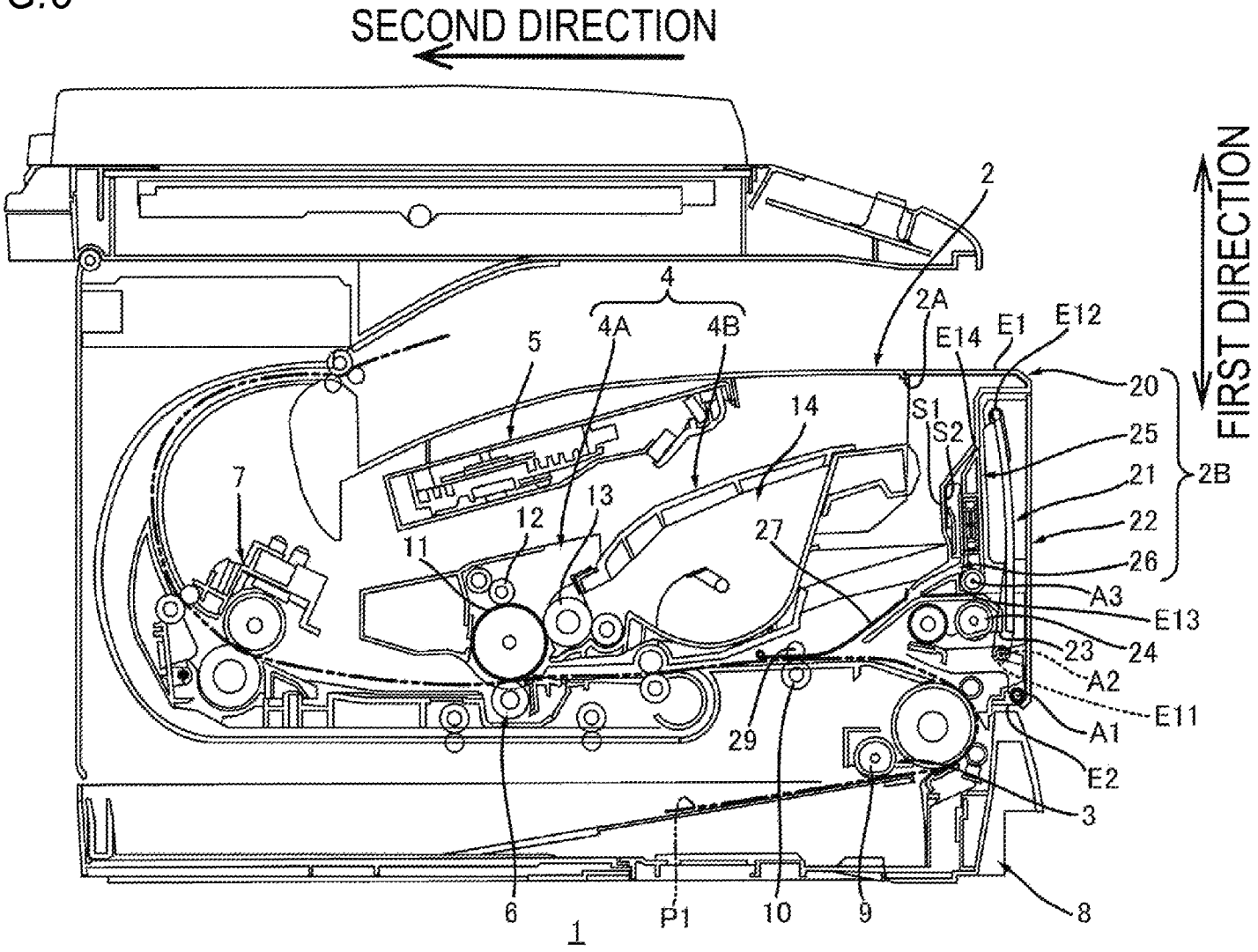
FIG. 3 shows the image forming apparatus shown in FIG. 1 with a state where the cover is positioned in the closed position, the first tray is positioned in the first position, and the second tray is positioned in the third position.

As shown in FIG. 3, in the present embodiment, the first tray 21 is a so-called multi-manual sheet feeding tray. A user can place a plurality of print media P2 on the first tray 21. The print medium P2 is a type of print medium different from the print medium P1 (see FIG. 1). For example, when the print medium P1 is A4 size print paper, the print medium P2 is a postcard or the like. The plurality of print media P2 placed on the first tray 21 are pulled into the main body casing 2 one by one by the second pickup roller 24.

The first tray 21 is positioned on the outer surface S2 of the cover body 20. The first tray 21 is movable with respect to the cover body 20 between the first position (See FIG. 3) and the second position (See FIG. 1) in a state where the cover 2B is positioned in the closed position. The first tray 21 is pivotable about the second axis A2 between the first position and the second position. The second axis A2 is positioned above the first axis A1 in a state where the cover 2B is positioned in the closed position.

When the cover 2B is positioned in the closed position and the first tray 21 is positioned in the first position, the first tray 21 is positioned on the opposite side of the photosensitive drum 11 with respect to the conveyance roller 10 in a second direction. The second direction is a direction from the conveyance roller 10 to the photosensitive drum 11. The second direction intersects the first direction and the axial direction. Preferably, the second direction intersects the first direction and is orthogonal to the axial direction. When the cover 2B is positioned in the closed position and the first tray 21 is positioned in the first position, the first tray 21 extends in the second direction. The first tray 21 includes a first end E11 at which the second axis A2 is positioned and a second end E12 separated from the second axis A2. When the cover 2B is positioned in the closed position and the first tray 21 is positioned in the first position, the first tray 21 can place the print medium P2. When the cover 2B is positioned in the closed position and the first tray 21 is positioned in the first position, the first tray 21 opens the second opening 23. In other words, when the cover 2B is positioned in the closed position and the first tray 21 is positioned in the first position, the first tray 21 does not cover the second opening 23. Accordingly, when the cover 2B is positioned in the closed position and the first tray 21 is positioned in the first position, the print medium P2 placed on the first tray 21 can pass through the second opening 23.

Further, as shown in FIG. 1, when the cover 2B is positioned in the closed position and the first tray 21 is positioned in the second position, the first tray 21 extends along the outer surface S2 of the cover body 20. When the cover 2B is positioned in the closed position and the first tray 21 is positioned in the second position, the first tray 21 extends in the first direction. When the cover 2B is positioned in the closed position and the first tray 21 is positioned in the second position, the first tray 21 cannot load the print medium P2. When the cover 2B is positioned in the closed position and the first tray 21 is positioned in the second position, the first tray 21 closes the second opening 23. In other words, when the cover 2B is positioned in the closed position and the first tray 21 is positioned in the second position, the first tray 21 covers the second opening 23.

Figure 4:
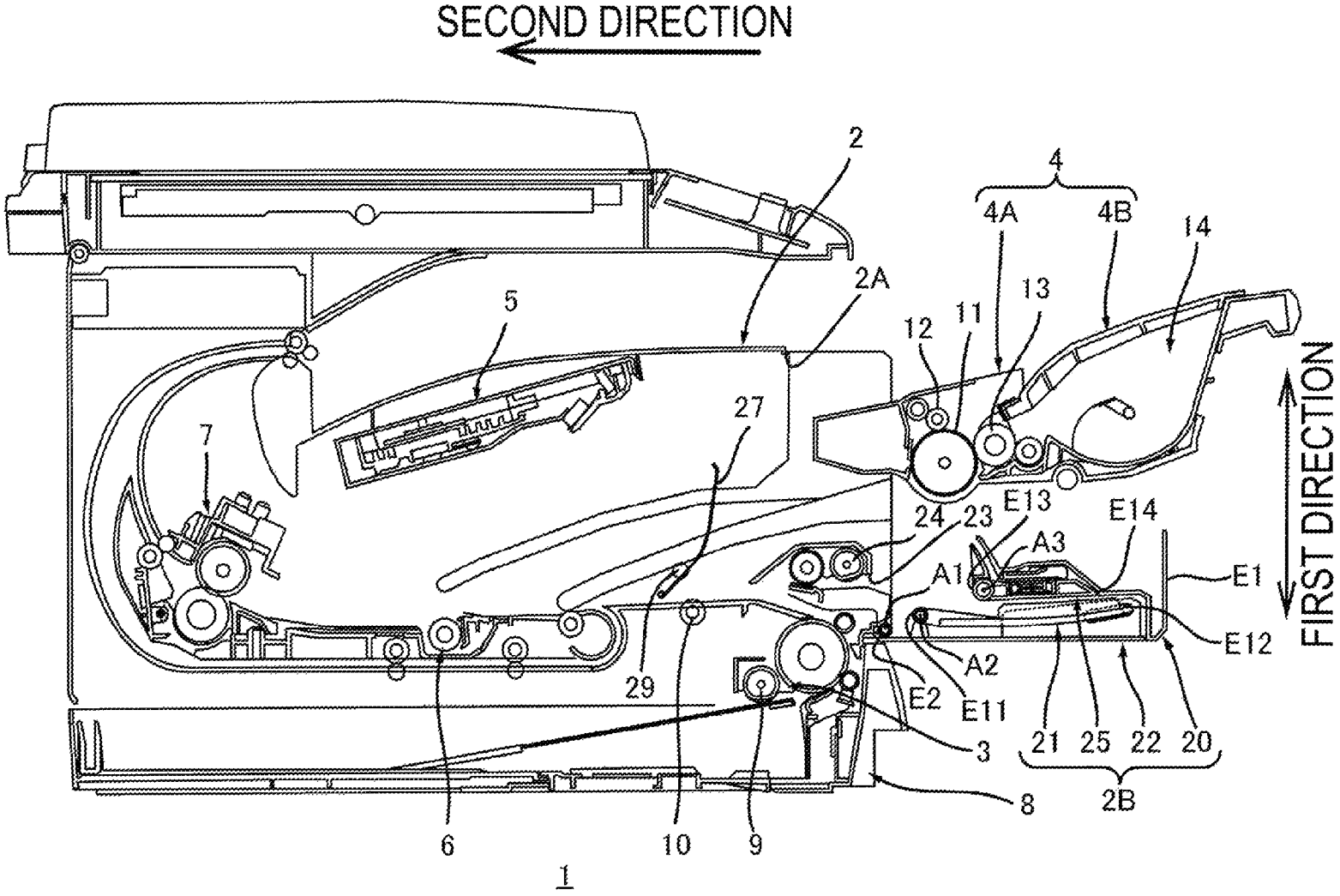
FIG. 4 is a plan view showing the first tray and the second tray shown in FIG. 3.

Further, as shown in FIG. 4, the first tray 21 includes two side guides 30A and 30B. The side guide 30A is positioned apart from the side guide 30B in a width direction of the print medium P2. The width direction of the print medium P2 is the same as the axial direction. The print medium P2 placed on the first tray 21 is positioned between the side guide 30A and the side guide 30B. Each of the side guide 30A and the side guide 30B is movable in the width direction. In a state where the first tray 21 is positioned in the first position (see FIG. 3), each of the side guides 30A and 30B protrudes upward from the top surface of the first tray 21. In a state where the first tray 21 is positioned in the first position, each of the side guide 30A and the side guide 30B extends in the second direction.

The user can adjust the distance between the side guide 30A and the side guide 30B to the width of the print medium P2 by moving each of the side guide 30A and the side guide 30B in the width direction. By adjusting the distance between the side guide 30A and the side guide 30B and the width of the print medium P2, the displacement of the print medium P2 in the width direction can be suppressed and the print medium P2 can be conveyed by the second pickup roller 24 (see FIG. 3). That is, the two side guides 30A and 30B guide the position of the print medium P2 in the width direction. The second pickup roller 24 will be described later.

In a state where the cover 2B is positioned in the closed position, the first tray 21 is positioned in the first position, and the second tray 25 is positioned in the third position, the side guide 30A and the side guide 30B are exposed in the second direction from the second tray 25.

2.3 Tray Cover

As shown in FIG. 1, the tray cover 22 is positioned on the outer surface S2 of the cover body 20. The tray cover 22 is pivotable about the first axis A1 between a cover first position (see FIG. 3) for positioning the first tray 21 in the first position and a cover second position (see FIG. 1) for positioning the first tray 21 in the second position. As shown in FIG. 3, when the tray cover 22 is positioned in the cover first position, the tray cover 22 supports the first tray 21 positioned in the first position. As shown in FIG. 1, when the tray cover 22 is positioned in the cover second position, the tray cover 22 covers the first tray 21 positioned in the second position.

2.4 Second Tray

As shown in FIG. 3, in the present embodiment, the second tray 25 is a so-called single-manual sheet feeding tray. The user can place one print medium P3 on the second tray 25. The print medium P3 is a type of print medium different from both of the print medium P1 and the print medium P2. For example, when the print medium P1 is A4 size print paper and the print medium P2 is a postcard, the print medium P3 is an envelope or the like. Specifically, the user loads one print medium P3 on the second tray 25 and inserts the print medium P3 into the third opening 26. The print medium P3 inserted into the third opening 26 is conveyed by the conveyance roller 10 toward the photosensitive drum 11.

At this time, the print medium P3 passes through the third opening 26. That is, the print medium P3 can pass through the third opening 26. In addition, the second tray 25 can place the print medium P3 passed through the third opening 26.

As shown in FIG. 1, the second tray 25 is positioned on the outer surface S2 of the cover body 20. The second tray 25 is movable with respect to the cover body 20 between the third position (see FIG. 3) and the fourth position (see FIG. 1) in a state where the cover 2B is positioned in the closed position. In a state where the cover 2B is positioned in the closed position, the first tray 21 is positioned in the second position, and the second tray 25 is positioned in the fourth position, the second tray 25 is positioned between the first tray 21 and the outer surface S2 of the cover body 20 in the second direction. The second tray 25 is pivotable about a third axis A3 between the third position and the fourth position in a state where the cover 2B is positioned in the closed position. The third axis A3 is positioned farther from the first axis A1 than the second axis A2 in the first direction in a state where the cover 2B is positioned in the closed position. Specifically, the third axis A3 is positioned above the second axis A2 in a state where the cover 2B is positioned in the closed position. The third axis A3 is positioned between the second axis A2 and the outer surface S2 of the cover body 20 in the second direction in a state where the cover 2B is positioned in the closed position. The second tray 25 includes a third end E13 at which the third axis A3 is positioned and a fourth end E14 separated from the third axis A3. In a state where the first tray 21 is positioned in the second position and the second tray 25 is positioned in the fourth position, when the cover 2B is positioned in the closed position, the third end E13 is positioned above the first end E11 of the first tray 21, and the fourth end E14 is positioned below the second end E12 of the first tray 21. Accordingly, in a state where the first tray 21 is positioned in the second position and the second tray 25 is positioned in the fourth position, when the cover 2B is positioned in the closed position, the second tray 25 can be accommodated by using a space above the first end E11 of the first tray 21 and below the second end E12 of the first tray 21, and the first tray 21 and the second tray 25 can be provided on the cover 2B while suppressing an increase in size of the cover 2B.

Further, as shown in FIG. 2, in a state where the first tray 21 is positioned in the second position and the second tray 25 is positioned in the fourth position, when the cover 2B is positioned in the open position, the second tray 25 overlaps the first tray 21 when viewed in the first direction. In a state where the first tray 21 is positioned in the second position and the second tray 25 is positioned in the fourth position, when the cover 2B is positioned in the open position, the second tray 25 is positioned farther from the one end E1 of the cover body 20 than the first tray 21 in the second direction. In a state where the first tray 21 is positioned in the second position and the second tray 25 is positioned in the fourth position, when the cover 2B is positioned in the open position, the third axis A3 is positioned closer to the one end E1 of the cover body 20 than the second axis A2 in the second direction. In a state where the first tray 21 is positioned in the second position and the second tray 25 is positioned in the fourth position, when the cover 2B is positioned in the open position, the third end E13 is positioned farther from the first axis A1 than the first end E11 of the first tray 21. Accordingly, in a state where the first tray 21 is positioned in the second position and the second tray 25 is positioned in the fourth position, when the cover 2B is positioned in the open position, a space between the second tray 25 and the first opening 2A can be secured in the second direction. Accordingly, it can be prevent that the second tray 25 hinders attachment and detachment of the cartridge 4 with respect to the image forming apparatus 1.

As shown in FIG. 3, when the cover 2B is positioned in the closed position and the second tray 25 is positioned in the third position, the second tray 25 is positioned on the opposite side of the photosensitive drum 11 with respect to the conveyance roller 10 in the second direction. When the cover 2B is positioned in the closed position and the second tray 25 is positioned in the third position, the second tray 25 is positioned between the one end E1 of the cover body 20 and the first tray 21 in the first position in a second direction. When the cover 2B is positioned in the closed position and the second tray 25 is positioned in the third position, the second tray 25 extends in the second direction. When the cover 2B is positioned in the closed position and the second tray 25 is positioned in the third position, the second tray 25 can place the print medium P3.

Here, when the cover 2B is positioned in the closed position, the first tray 21 is positioned in the first position, and the second tray 25 is positioned in the third position, the first tray 21 and the tray cover 22 extend to the opposite side of the third opening 26 with respect to the second tray 25 in the second direction. Accordingly, when the print medium P3 placed on the second tray 25 protrudes from the second tray 25, the protruding portion of the print medium P3 is supported by the first tray 21 and the tray cover 22. Thus, even when the print medium P3 protrudes from the second tray 25, the print medium P3 does not easily fall off the second tray 25.

When the cover 2B is positioned in the closed position and the second tray 25 is positioned in the third position, the second tray 25 opens the third opening 26. In other words, when the cover 2B is positioned in the closed position and the second tray 25 is positioned in the third position, the second tray 25 does not cover the third opening 26. Accordingly, when the cover 2B is positioned in the closed position and the second tray 25 is positioned in the third position, the print medium P3 placed on the second tray 25 can pass through the third opening 26.

As shown in FIG. 1, when the cover 2B is positioned in the closed position and the second tray 25 is positioned in the fourth position, the second tray 25 is positioned between the outer surface S2 of the cover body 20 and the first tray 21 in the first position in the second direction. When the cover 2B is positioned in the closed position and the second tray 25 is positioned in the fourth position, the second tray 25 extends along the outer surface S2 of the cover body 20. When the cover 2B is in the closed position and the second tray 25 is in the fourth position, the second tray 25 extends in the first direction. When the cover 2B is positioned in the closed position and the second tray 25 is positioned in the fourth position, the second tray 25 cannot load the print medium P3. When the cover 2B is positioned in the closed position and the second tray 25 is positioned in the fourth position, the second tray 25 closes the third opening 26. In other words, when the cover 2B is positioned in the closed position and the second tray 25 is positioned in the fourth position, the second tray 25 covers the third opening 26.

Further, as shown in FIG. 4, the second tray 25 includes two side guides 28A and 28B. The side guide 28A is positioned apart from the side guide 28B in the width direction of the print medium P3. The print medium P3 placed on the second tray 25 is positioned between the side guide 28A and the side guide 28B. Each of the side guide 28A and the side guide 28B is movable in the width direction. In a state where the second tray 25 is positioned in the third position, each of the side guides 28A and 28B protrudes upward from the top surface of the second tray 25. In a state where the second tray 25 is positioned in the third position, each of the side guide 28A and the side guide 28B extends in the second direction.

The user can adjust the distance between the side guide 28A and the side guide 28B to the width of the print medium P3 by moving each of the side guide 28A and the side guide 28B in the width direction. By adjusting the distance between the side guide 28A and the side guide 28B and the width of the print medium P3, the displacement of the print medium P3 in the width direction can be suppressed and the print medium P3 can be conveyed by the conveyance roller 10 (see FIG. 3). That is, the two side guides 28A and 28B guide the position of the print medium P3 in the width direction. The two side guides 28A and 28B guide the position of the print medium passed through the third opening 26 in the width direction.

2.5 Third Opening

As shown in FIG. 3, the third opening 26 is provided in the cover body 20. The third opening 26 is positioned between the first opening 2A and the second opening 23. The third opening 26 extends in the width direction of the print medium P3.

3. Details of Image Forming Apparatus

Next, the details of the image forming apparatus 1 will be described with reference to FIG. 3.

The image forming apparatus 1 further comprises the second opening 23, the second pickup roller 24, and the guide 27.

3.1 Second Opening

The second opening 23 is positioned below the first opening 2A. The second opening 23 is positioned between the first opening 2A and the cassette 8. The second opening 23 extends in the width direction of the print medium P2.

3.2 Second Pickup Roller

The second pickup roller 24 is positioned between the conveyance roller 10 and the first tray 21 positioned in the first position in the first direction. The second pickup roller 24 picks up the print medium P2 placed on the first tray 21 and draws the print medium P2 into the main body casing 2. At this time, the print medium P2 placed on the first tray 21 passes through the second opening 23. After the print medium P2 placed on the first tray 21 passes through the second opening 23 and are drawn into the main body casing 2, the photosensitive drum 11 is conveyed by the conveyance roller 10 in the same manner as the print medium P1 from the cassette 8. That is, the conveyance roller 10 conveys the print medium P2 passed through the second opening 23.

3.3 Guide

The guide 27 guides the print medium P3 passed through the third opening 26 to the conveyance roller 10. The guide 27 includes a second conveyance roller 29. Further, as shown in FIG. 2 and FIG. 3, the guide 27 is movable between the contact position (see FIG. 3) and the separation position (see FIG. 2).

As shown in FIG. 3, when the guide 27 is positioned in the contact position, the second conveyance roller 29 contacts the conveyance roller 10. Accordingly, when the guide 27 is positioned in the contact position, the second conveyance roller 29 conveys the print medium P3 together with the conveyance roller 10. When the guide 27 is positioned in the contact position, the guide 27 is positioned between the third opening 26 and the conveyance roller 10 in the second direction. When the guide 27 is positioned in the contact position, the guide 27 extends from the third opening 26 toward the conveyance roller 10. When the guide 27 is positioned in the contact position, the guide 27 is positioned below the first opening 2A in the first direction.

As shown in FIG. 2, when the guide 27 is positioned in the separation position, the second conveyance roller 29 separates from the conveyance roller 10. Thus, when the print medium P3 is jammed between the third opening 26 and the conveyance roller 10, the guide 27 can be positioned in the separation position, and the jammed print medium P3 can be removed.

According to this disclosure, an image forming apparatus for use with a cartridge accommodating toner may include a main body casing having a first opening, a second opening positioned below the first opening, and a third opening positioned between the first opening and the second opening; a first conveyance roller for conveying a sheet passed through the second opening; a cover coupled to the main body casing to be pivotable about a first axis for opening and closing the first opening, the cover comprising a first tray for supporting the sheet, the first tray comprising a first sheet guide for guiding the sheet on the first tray to the first conveyance roller through the second opening, wherein the cartridge is mountable to the main body casing through the first opening in a state where the cover is opened.

4. Operational Effects

As shown in FIG. 3, the image forming apparatus 1, which includes the first opening 2A (see FIG. 2) for mounting the cartridge 4 in the image forming apparatus 1 and the cover 2B capable of opening and closing the first opening 2A, comprises the first tray 21 provided in the cover 2B and the third opening 26 through which the print medium P3 can pass and different from the second opening 23 through which the print medium P2 placed on the first tray 21 passes.

Therefore, in a state where the print medium P2 is placed on the first tray 21, printing can be performed on the print medium P3 different from the print medium P2 placed on the first tray 21 by using the third opening 26.

The image forming apparatus 1 can convey the print medium P3 passed through the third opening 26 by using the conveyance roller 10 for conveying the print medium P2 passed through the second opening 23.

Therefore, the complexity of the configuration of the image forming apparatus 1 can be suppressed and printing can be performed on the print medium P3 different from the print medium P2 placed on the first tray 21.

Furthermore, the image forming apparatus 1 comprises the cassette 8. The cassette 8 can accommodate the print medium P1 and can be mounted to the main body casing 2.

That is, in a state where the print medium P1 is accommodated in the cassette 8 and the print medium P2 is placed on the first tray 21, the image forming apparatus 1 can print on the print medium P3 different from both the print medium P1 of the cassette 8 and the print medium P2 placed on the first tray 21.

In the image forming apparatus 1, as shown in FIG. 2, the guide 27 is movable to the separation position where the second conveyance roller 29 separates from the conveyance roller 10.

Therefore, when the print medium P3 is jammed between the third opening 26 and the conveyance roller 10, the guide 27 can be positioned in the separation position, and the jammed print medium P3 can be removed.

5. Modification

A modification is described with reference to FIG. 5 to FIG. 7. In the modification, the same members as those in the above-described embodiment are denoted by the same reference numerals, and the description thereof is omitted.

Figure 5:
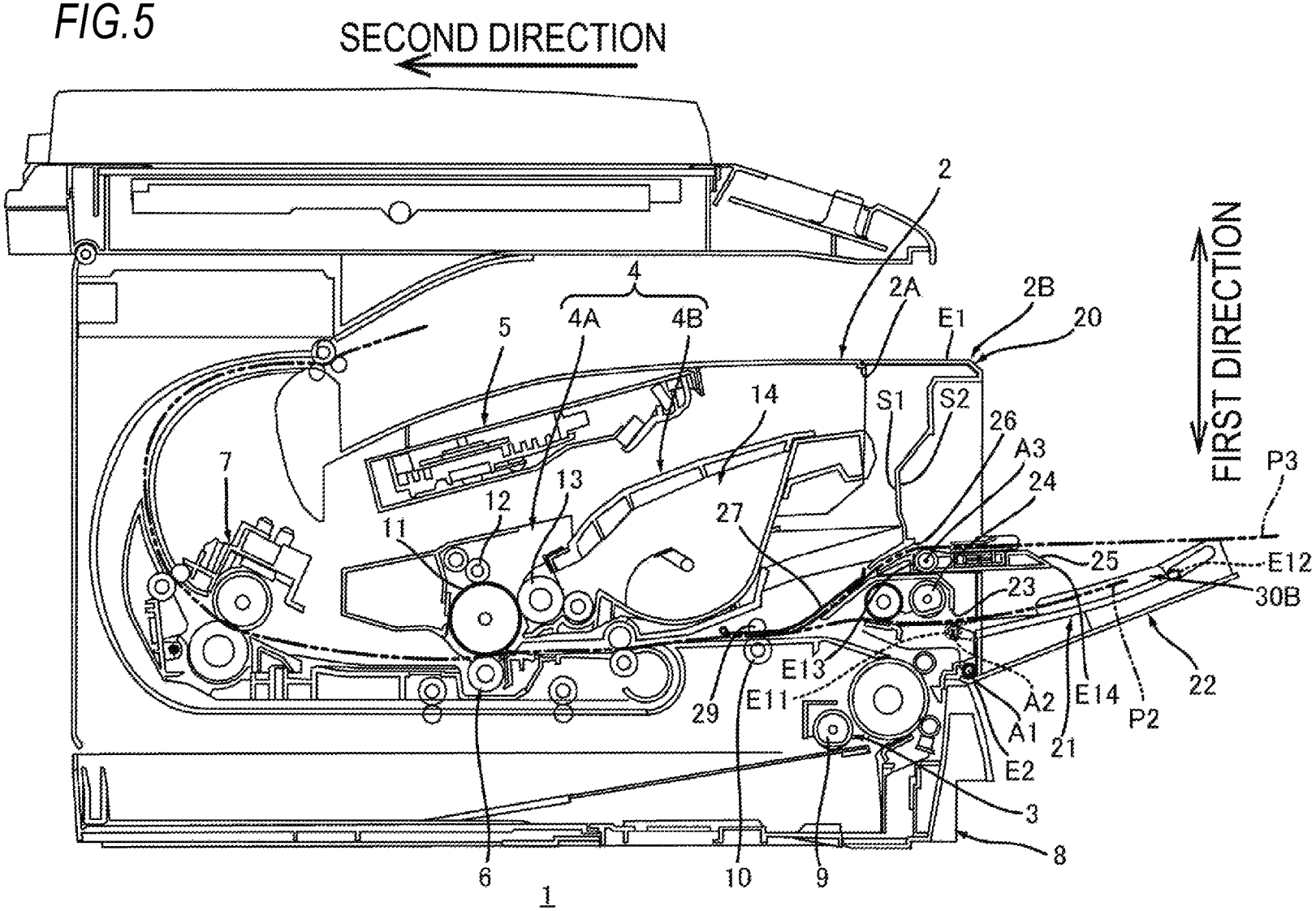
FIG. 5 is an illustrative view for illustrating a first modified example, and shows a state where the cover is positioned in the open position and the cartridge is removed from the image forming apparatus.
Figure 6:
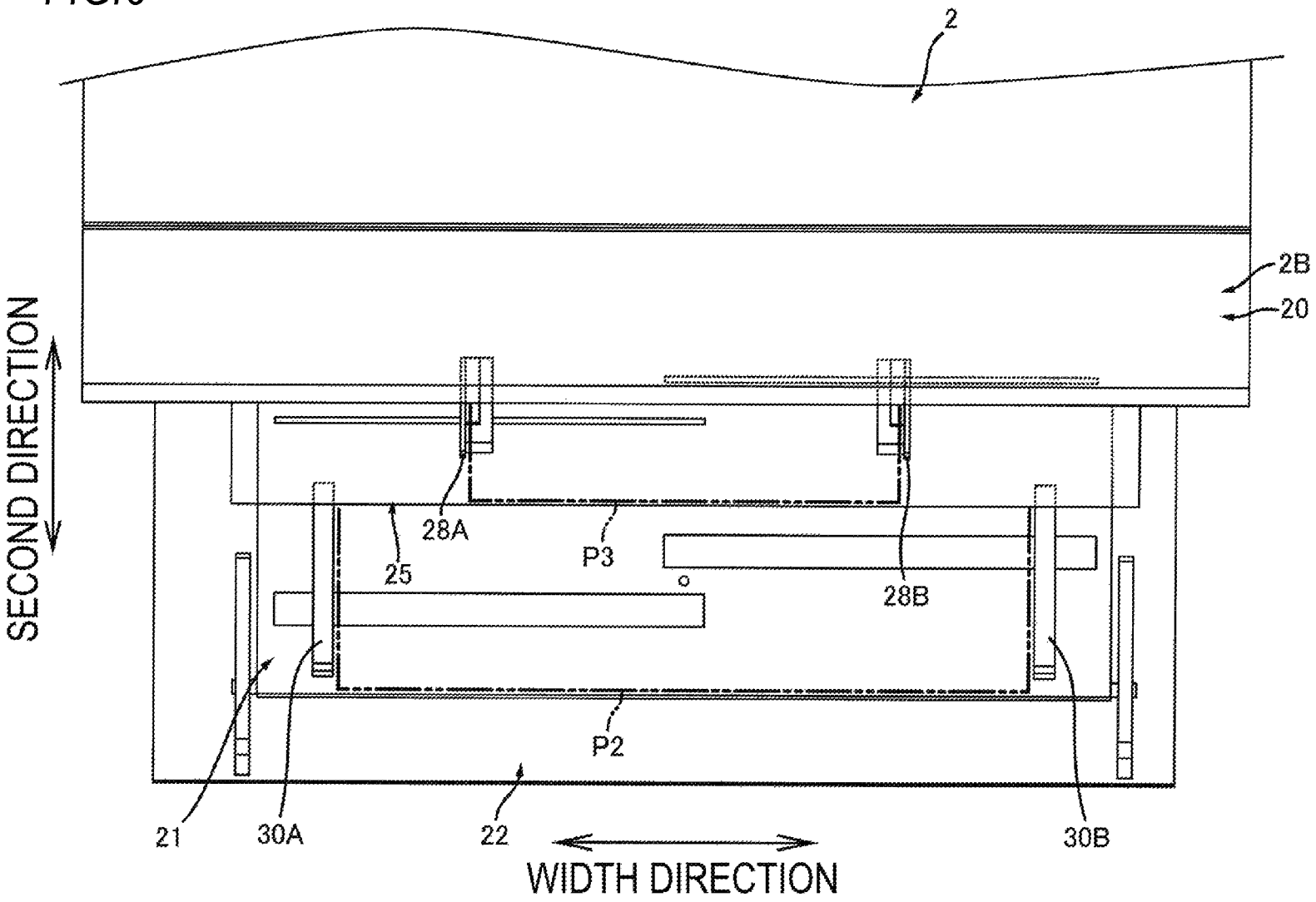
FIG. 6 is an illustrative view for illustrating the first modification together with FIG. 5, and shows a state where the cover is positioned in the closed position and the first tray is positioned in the first position.

As shown in FIG. 5 and FIG. 6, the second tray 31 is not provided on the cover 2B, and may be provided on the main body casing 2. In this case, the second tray 31 may include two side guides 32A and 32B. That is, the main body casing 2 may have two side guides 32A and 32B. The side guide 32A is not illustrated. The side guide 32A has the same structure as the side guide 28A of the first embodiment, and can be described in the same manner as the side guide 28A. The side guide 32B has the same structure as the side guide 28B of the first embodiment, and can be described in the same manner as the side guide 28B. Therefore, the description of the structures of the two side guides 32A and 32B is omitted. The two side guides 32A and 32B guide the position of the print medium P3 which passes through the third opening 26 in the width direction.

Figure 7:
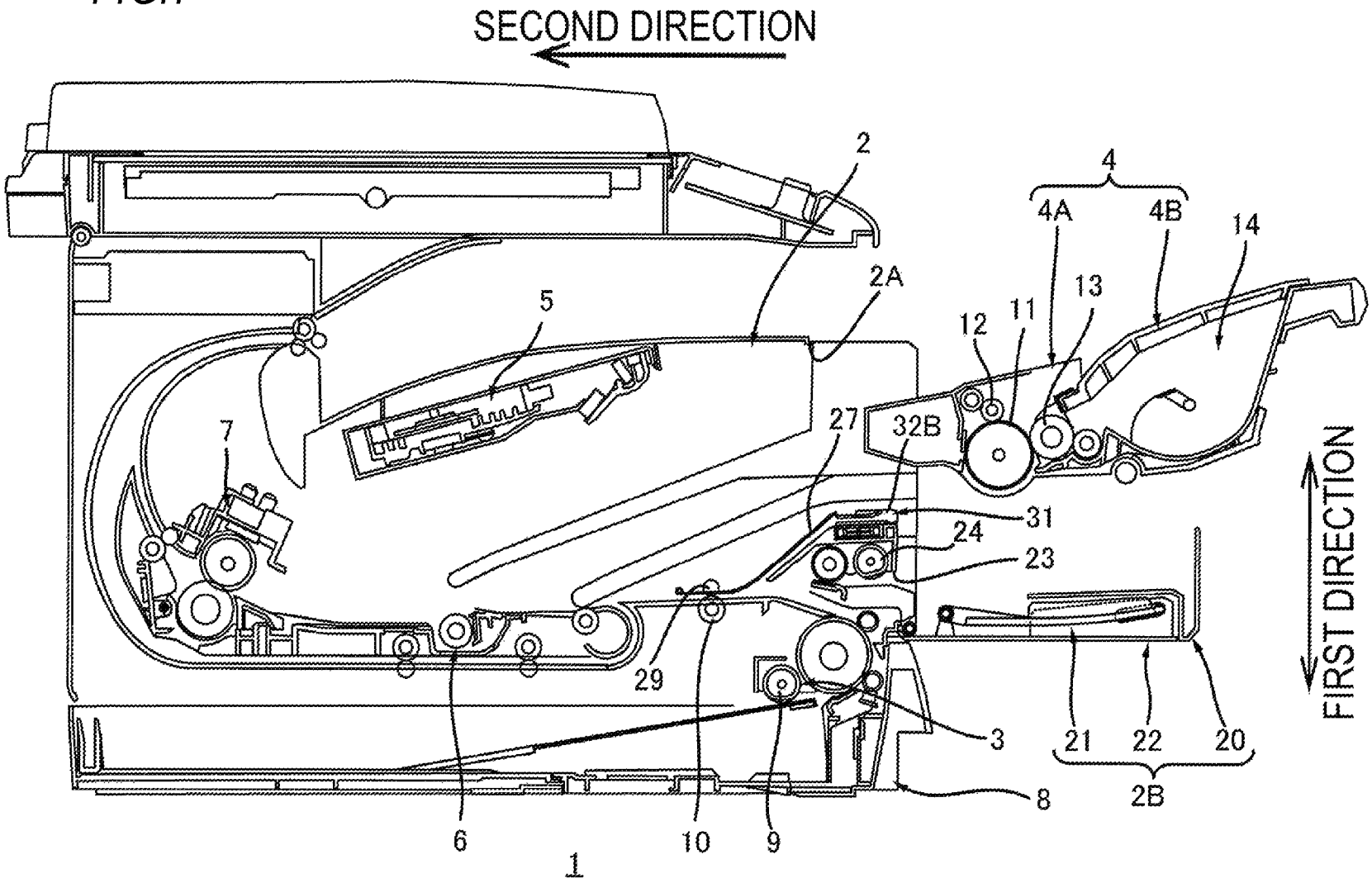
FIG. 7 is an illustrative view for illustrating a second modification.

As shown in FIG. 7, a second tray 41 may be a single manual paper feeding tray.

What is claimed is:

1. An image forming apparatus, comprising:

a main body casing including: a cover that is movable between an open position, at which a first opening of the main body casing is opened, and a closed position, at which the first opening is closed; and a cartridge, which is capable of accommodating a toner and is mountable to the main body casing via the first opening, in a state where the cover is positioned in the open position;

wherein the main body casing includes:

a first conveyance roller which is positioned below the first opening and conveys a sheet;

a sheet feeding tray, which is provided on the cover and is capable of supporting a first sheet for feeding to the first conveyance roller; and a guide, which guides a second sheet passed through a third opening of the main body casing for feeding to the first conveyance roller, the third opening being positioned between the first opening and the second opening.

2. The image forming apparatus according to claim 1, further comprising:

a cassette, which is capable of accommodating a print medium and is mountable to the main body casing and which is positioned below the cartridge in the state where the main body casing is mounted; and a first pickup roller to pick up the print medium accommodated in the cassette.

3. The image forming apparatus according to claim 1, further comprising a second pickup roller to pick up the print medium placed on the first tray.

4. The image forming apparatus according to claim 1, wherein, in a state where the cover is positioned in the closed position, the first tray is movable between a first position, at which the second opening is opened and the print medium can be placed, and a second position, at which the printing medium cannot be placed.

5. The image forming apparatus according to claim 1, wherein the cover includes a second tray capable of placing the print medium passed through the third opening.

6. The image forming apparatus according to claim 5, wherein the second tray includes a side guide to guide a position of the print medium in the width direction.

7. The image forming apparatus according to claim 5, wherein the cover is pivotable about a first axis between the open position and the closed position;

in a state where the cover is positioned in the closed position, the first tray is pivotable about a second axis positioned above the first axis between a first position, at which the second opening is opened, and a second position, at which the second opening is closed;

the first tray includes a first end, at which the second axis is positioned, and a second end separated from the second axis;

in a state where the cover is positioned in the closed position, the second tray is pivotable about a third axis positioned above the second axis between a third position, at which the third opening is opened, and a fourth position, at which the third opening is closed;

the second tray includes a third end, at which the third axis is positioned, and a fourth end separated from the third axis; and in a state where the first tray is positioned in the second position and the second tray is positioned in the fourth position, when the cover is positioned in the closed position, the third end is positioned above the first end and the fourth end is positioned below the second end.

8. The image forming apparatus according to claim 5, wherein the cover is pivotable about a first axis between the open position and the closed position;

in a state where the cover is positioned in the closed position, the first tray is pivotable about a second axis positioned above the first axis between a first position, at which the second opening is opened, and a second position, at which the second opening is closed;

the first tray includes a first end in which the second axis is positioned and a second end separated from the second axis;

in a state where the cover is positioned in the closed position, the second tray is pivotable about a third axis positioned above the second axis between a third position, at which the third opening is opened, and a fourth position, at which the third opening is closed;

the second tray includes a third end, at which the third axis is positioned, and a fourth end separated from the third axis; and in a state where the first tray is positioned in the second position and the second tray is positioned in the fourth position, when the cover is positioned in the open position, the third end is positioned farther from the first axis than the first end.

9. The image forming apparatus according to claim 1, wherein the main body casing includes a side guide to guide a position of the print medium passed through the third opening in a width direction.

10. The image forming apparatus according to claim 1, wherein the guide includes a second conveyance roller to convey the print medium together with the first conveyance roller, and the guide is movable between a contact position, at which the second conveyance roller contacts the first conveyance roller, and a separation position, at which the second conveyance roller is separated from the first conveyance roller.

11. An image forming apparatus for use with a cartridge accommodating toner, the image forming apparatus comprising:

a main body casing comprising a cover, the main body casing having a first opening, a second opening positioned below the first opening, and a third opening positioned between the first opening and the second opening;

a first conveyance roller for conveying a sheet;

a first guide, which guides a first sheet passed through the second opening to the first conveyance roller;

a second guide, which guides a second sheet passed through the third opening to the first conveyance roller;

wherein the cover is coupled to the main body casing to be pivotable about a first axis for opening and closing the first opening, the cover comprising a first tray for supporting the first sheet, the first tray comprising a first sheet guide for guiding the first sheet on the first tray to the first conveyance roller through the second opening;

wherein the cartridge is mountable to the main body casing through the first opening in a state where the cover is opened.

12. The image forming apparatus according to claim 11, wherein the cover further comprises a second tray for supporting a sheet, the second tray comprising a second sheet guide for guiding the sheet on the second tray to the first conveyance roller through the third opening.

13. The image forming apparatus according to claim 12, further comprising a pick-up roller at the second opening for picking up sheet placed on the first tray.

14. The image forming apparatus according to claim 12, wherein the first tray is coupled to the cover to be pivotable about a second axis, and the first tray is foldable and expandable relative to the cover, wherein the second tray is coupled to the cover to be pivotable about a third axis, and the second tray is foldable and expandable relative to the cover, and wherein, in a state where the first tray is folded and the second tray is folded, the second tray is covered by the first tray.

15. The image forming apparatus according to claim 12, wherein the first tray is coupled to the cover to be pivotable about a second axis, and the first tray is foldable and expandable relative to the cover, wherein the second tray is coupled to the cover to be pivotable about a third axis, and the second tray is foldable and expandable relative to the cover, wherein, in a state where the cover is closed and the first tray is folded, the first tray covers the second opening, and wherein, in a state where the cover is closed and the second tray is folded, the third opening is covered by the second tray.

16. An image forming apparatus, comprising:

a main body casing including: a cover that is movable between an open position, at which a first opening of the main body casing is opened, and a closed position, at which the first opening is closed; and a cartridge, which is capable of accommodating a toner and is mountable to the main body casing via the first opening, in a state where the cover is positioned in the open position;

wherein the main body casing includes:

a first tray, which is provided on the cover and is capable of placing a print medium thereon;

a first conveyance roller positioned below the first opening, the first conveyance roller conveying the print medium;

a first guide, which guides the print medium placed on the first tray to the first conveyance roller; and a second guide, which guides the print medium passed through a third opening of the main body casing to the first conveyance roller, the third opening being positioned between the first opening and the second opening.

* * * * *